United States Patent [19]

Tartaglia et al.

[11] Patent Number: 4,671,174

[45] Date of Patent: Jun. 9, 1987

[54] MULTICOLOR SILK SCREEN PRINTING MACHINE WITH MOVEABLE HEATING CARRIAGE

[76] Inventors: Marc S. Tartaglia; Marc S. Tartaglia, Jr.; Michael J. Tartaglia, all of 51 Petry Dr., East Hanover, N.J. 07936

[21] Appl. No.: 876,932

[22] Filed: Jun. 20, 1986

[51] Int. Cl.[4] ..... B41F 15/04

[52] U.S. Cl. ..... 101/115; 101/123; 101/128.1

[58] Field of Search ..... 101/114–115, 101/123, 127, 127.1, 128, 128.1, 129

[56] References Cited

U.S. PATENT DOCUMENTS

| | | | |
|---|---|---|---|
| 2,846,946 | 8/1958 | Schwarzberger | 101/115 |
| 3,106,890 | 10/1963 | Schmitt | 101/115 |
| 4,186,660 | 2/1980 | Key | 101/128.1 |
| 4,287,826 | 9/1981 | Brabec | 101/115 |
| 4,493,254 | 1/1985 | Landesman et al. | 101/115 |
| 4,583,458 | 4/1986 | Beachum | 101/115 |

*Primary Examiner*—E. H. Eickholt
*Attorney, Agent, or Firm*—Edward R. Weingram

[57] ABSTRACT

Multi-colored designs are applied on a plurality of textile fabric or sheet materials with a silk screen printer having several platens arranged in two horizontal rows below a longitudinal heater which is movable across either row. The textiles, such as articles of clothing, are placed over respective platens and secured in pivotable hold down frames. A silk screen with a desired design is secured in a screen frame having a corner registration guide and is positioned against a main registration guide affixed to the hold down frame to align the design on the article. The color ink material is applied with a squeegee through the screen onto the article, and this is repeated manually with the same screen frame and design successively at each platen for several like articles. After application of heat to set the first color along the row of articles, another screen frame with a screen having a related pattern for the next color and another registration guide mounted on the corner of the screen frame is positioned against the main guide to apply the second color at the desired location on each article. Any number of colors can be applied successively using pre-registered screen designs secured in frames with guides attached to achieve precise registration. The longitudinal heater is moved across each row of article after application of each color to set the colors on all of the items in one operation.

11 Claims, 9 Drawing Figures

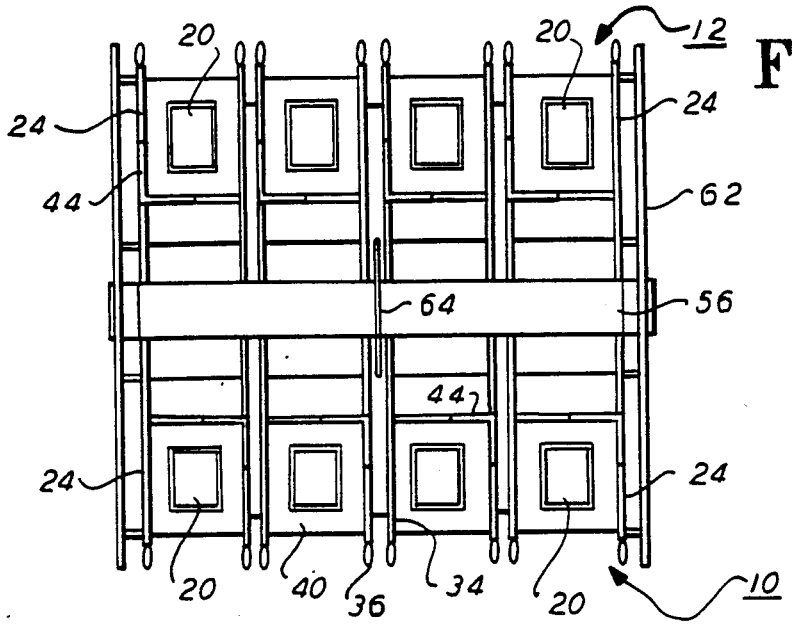
FIG. 1
FIG. 2
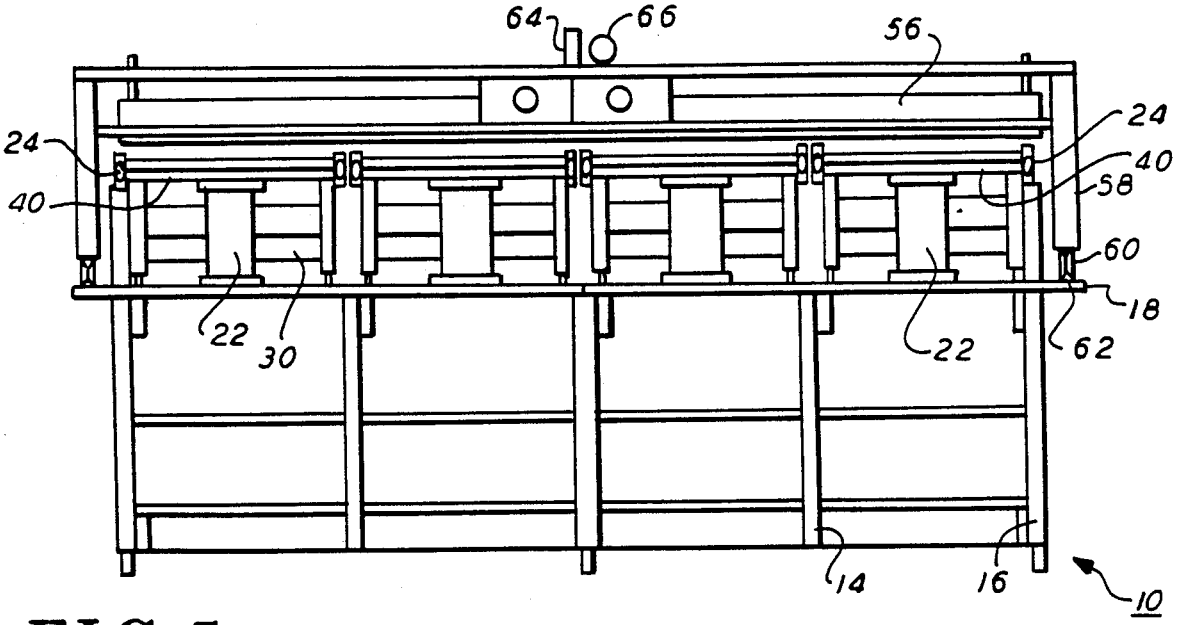
FIG. 5
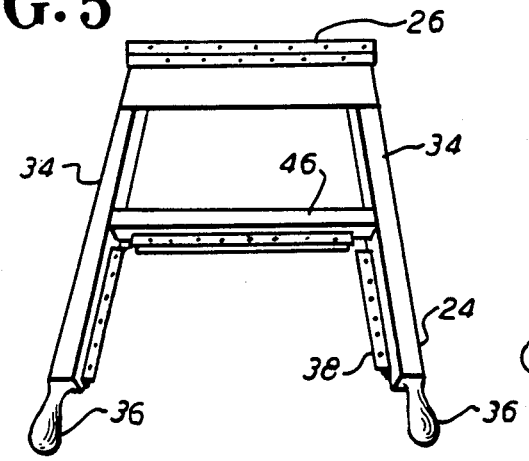
FIG. 6
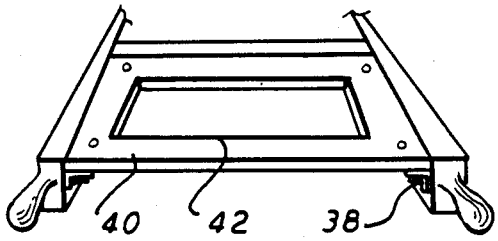

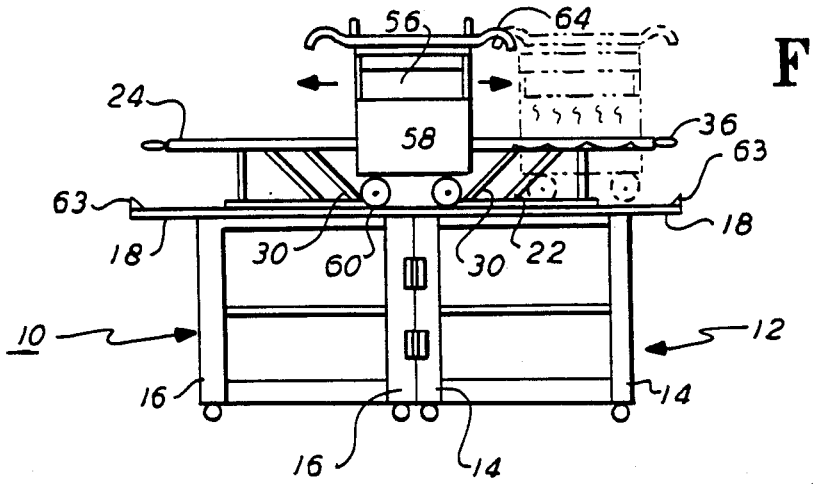
FIG. 3
FIG. 4
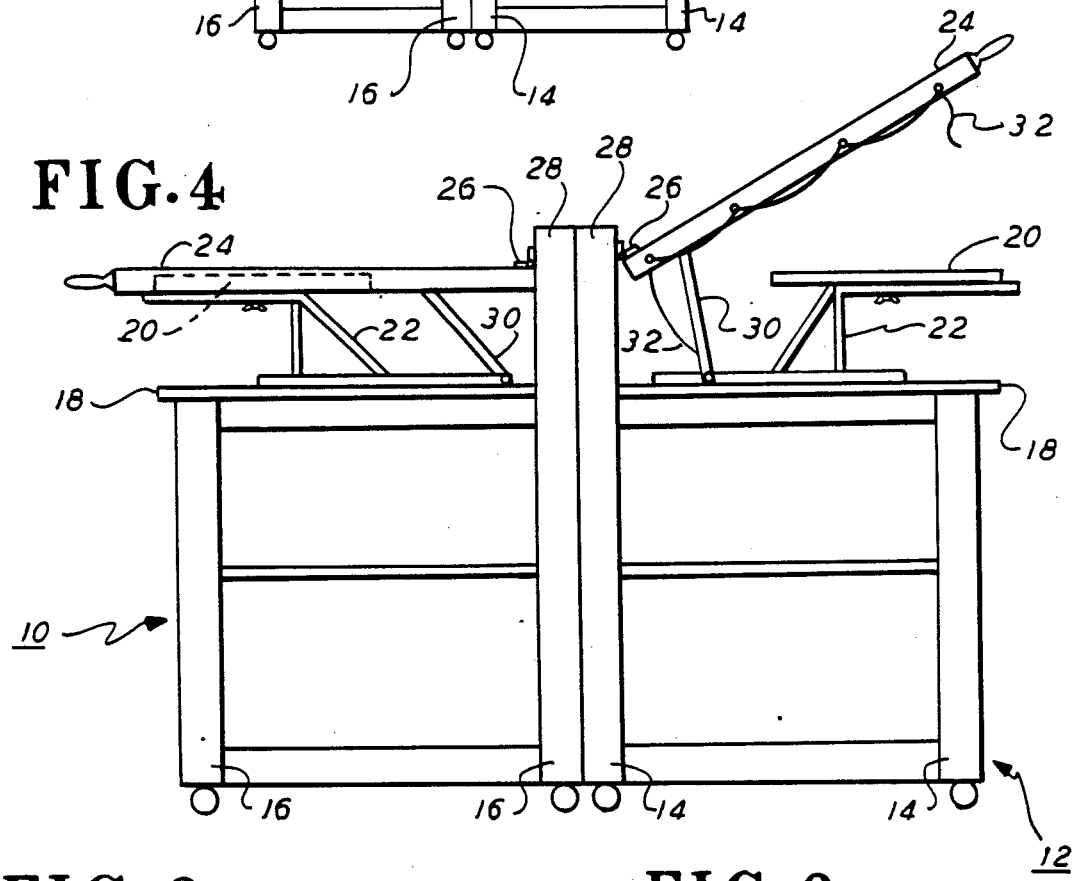
FIG. 8
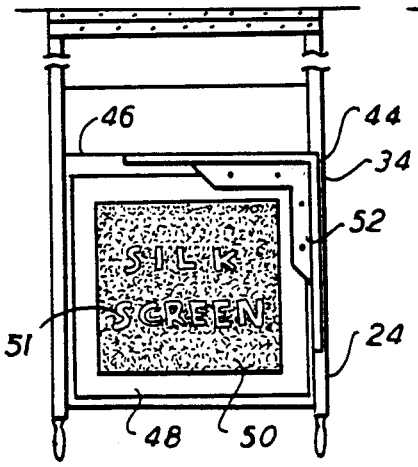
FIG. 9
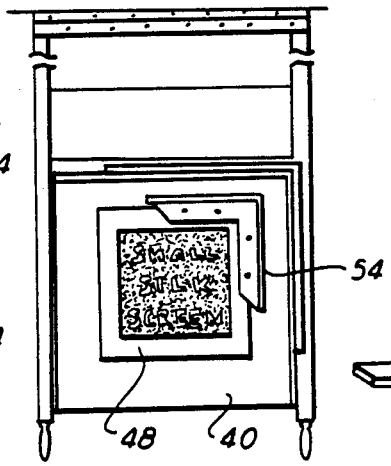
FIG. 7
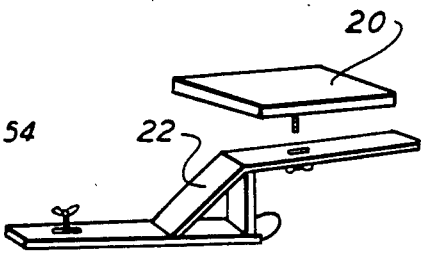

MULTICOLOR SILK SCREEN PRINTING MACHINE WITH MOVEABLE HEATING CARRIAGE

BACKGROUND OF THE INVENTION

1. Field of the Invention

The present invention relates to an apparatus for silk screen printing on fabrics and particularly to a machine which is capable of printing multi-color repetitive patterns or designs on a plurality of articles with high precision.

2. Description of the Prior Art

Presently known multiple station silk screen printers include automated rotary tables having fabrics secured in platens which are moved around from station to station with a squeegee applying different colors through successive screens at each position. Heat may be applied at one station for drying the ink patterns, or the articles may be removed and passed through a separate heating chamber. A second type of multi-station printer, described in U.S. Pat. No. 4,287,826, utilizes a supporting frame having moving upper and lower horizontal tracks carrying platens with articles which are automatically fed through loading, printing and end heating stations in a linear continuous operation. U.S. Pat. Nos. 3,106,890 and 2,846,946 show similar longitudinal conveyor printing machines with devices for automatically moving a squeegee across a screen to apply different colors to work pieces at successive positions. The difficulty in achieving accurate registration when printing a pattern having a plurality of colors is described in U.S. Pat. No. 4,084,500, which utilizes registration marks and photoelectric detectihg devices. Rotary, as well as longitudinal continuous feed printers, require phase adjustment mechanisms to obtain the necessary precision.

SUMMARY OF THE INVENTION

It is therefore a primary object of the present invention to provide a silk screen printing machine capable of printing multi-color patterns on a plurality of textile articles or sheet materials with high precision.

A further object of the invention is to provide a relatively simple manually operable machine which permits application of repetitive multi-color patterns on a plurality of like articles with precise registration.

Another object of the invention is to apply the same color patterns to successive articles in stationary platens using silk screen frames having precision registration guides.

An additional object of the invention is to provide a heating and drying mechanism for a silk screen printing machine which permits application of heat after the printing of each color pattern and which is capable of drying a plurality of items simultaneously.

These objects are achieved with a silk screen printing machine having a plurality of stationary platens arranged in two parallel horizontal rows and a longitudinal heater mounted on end rollers to permit movement across either row. Individual articles of clothing are placed on respective platens and secured in pivottable hold down frames which include a main registration guide in one corner. A silk screen with a desired design in a predetermined position is secured in a screen frame including a second corner registration guide which fits against the main guide to locate the design on the article. A squeegee manually applies the color ink or paste material through the screen onto the article which step is repeated with the same screen frame and design at each successive platen. The heater is then moved across the rows of platens and articles to set the first color. Thereafter, a second screen frame and screen with a related pattern and another corner registration guide offset from the first screen guide is ARTA 3.0-001 positioned against the main guide to permit application of the second color at the proper position on each work piece. A plurality of colors can thus be applied successively utilizing related screen patterns and guides to achieve precise registration at each platen. The longitudinal heater is again moved across each row following each application of color to set and dry the colors on all of the articles in one operation. Other objects and advantages will become apparent from the following description in conjunction with the accompanying drawings.

BRIEF DESCRIPTION OF THE DRAWINGS

FIG. 1 is a plan view of the novel silk screen printing machine showing two parallel rows of platens and hold down frames for a plurality of cloth articles and a longitudinal heater;

FIG. 2 is a front view of the silk screen printer showing a row of article holders and a heater;

FIG. 3 is an end view of the printing machine showing two cloth article holding frames and the heater;

FIG. 4 is another end view of the printer showing the holding frames in up and down positions over a pair of platens;

FIG. 5 is a top perspective view of a hold down frame of the printing machine;

FIG. 6 is a top perspective view of a platen frame secured in a hold down frame;

FIG. 7 is a side angle view of a platen and platen holder;

FIG. 8 is a top view of a hold down frame and silk screen frame and respective registration guides; and FIG. 9 is a top view of a smaller silk screen frame and associated registration guide.

DESCRIPTION OF THE PREFERRED EMBODIMENT

As shown in FIGS. 1, 2, 3 and 4, two rows of like work stations 10, 12 are arranged symmetrically along a longitudinal support structure. Each work station includes pairs of supporting legs 14, 16 and a horizontal platform 18. Secured to the platform at each station is a horizontal platen 20 and a platen holder 22, which are shown in more detail in FIG. 7. The platen holder includes slots to permit some adjustment of the lateral position. A pivotable hold down frame 24 is secured by hinges 26 to vertical back support 28. A kick stand 30 pivotally secured to the hold down frame 24 and slidable along platform 18 supports the frame 24 in a raised position, as shown in FIG. 4 on the right side. A pull cord or wire 32 moves the lower kick stand rearwardly to permit the hold down frame to be lowered into the horizontal position shown on the left side of FIG. 4.

As shown in FIG. 5, the hold down frame includes two side bars 34 having handles 36 at the ends. A rectangular open area at the front includes frame holders 38 which engage a platen frame 40, shown in FIG. 6. The enclosed rectangular area 42 in platen frame 40 receives the platen 20 when the hold down frame 24 is in the lowered position as shown on the left side of FIG. 4. As shown in FIG. 8, a 90° angle member 44 is secured along the corner of the right side bar 34 and cross member 46 to establish a fixed main registration guide. Each silk screen frame 48 having a silk screen 50 with a desired design, pattern, lettering, etc., indicated at 51, has an individual screen registration guide or 90° angle member 52 secured to the upper right corner of the screen frame. When the screen registration guide 52 at the corner engages the main registration guide 44, the position of the screen design pattern is established with respect to the platen frame and platen below the screen frame. In order to accommodate different size platens, the platen frame 40 is removable and a frame having a smaller opening 42 to receive a smaller platen may be secured to the hold down frame 24. As shown in FIG. 9, a platen frame 40 may have a different registration guide 54 secured thereon, so that a smaller silk screen frame 48 with a smaller corner angle guide 52 can be positioned over a smaller platen member with precise registration.

FIGS. 1, 2 and 3 also show a movable longitudinal heater structure 56 and frame supported on legs 58 having rollers or caster-type wheels 60 which move along angle iron tracks 62 at opposite ends of platform 18. A stop 63 prevents the heater from running off the platform. The heater includes longitudinal heating elements which permit application of heat along the plurality of work stations on one side of the machine at the same time while the tracks permit lateral movement across all of the like work stations on the opposite side which are also subject to heat in one operation. A handle 64 permits manual movement of the heater and a timer and control element 66 permits application of heat for a desired time and amount. The heating element mounting on the frame may also be adjusted in height above the work stations.

In operation, a plurality of like textile articles, such as shirts or jackets, are placed respectively on each platen 20 so that a desired area on which a design is to be printed is centered on the platen at each work station. The pull cord 32 at each location is pulled forward to move the kick stand 30 rearwardly to permit lowering the hold down frame 24 into a horizontal position so that platen frame 40 fits closely around the garment which is supported on the platen and hangs down over the edges. A rubber edging (not shown) secured to the lower inside border of frame 40 may be used to provide a snug fit around the edges of the platen and garment. The end of the horizontal support member of platen holder 22 extends beyond the edge of the platen 20 and platen frame 40 to provide a stop and maintain the hold down frame in the horizontal position. Each garment is thus held in substantially the same position at each work station.

A silk screen frame 48, having a screen 50 with a desired design or lettering 51 to permit passage of printing ink and coloring materials therethrough in the area of the design, is positioned over the garment. The 90° angle screen registration guide 52 secured on one corner is moved into engagement with the main angle registration guide 44 mounted on the side bar 34 and cross member 46 of the hold down frame so that the design is precisely positioned at a predetermined location with respect to the garment on the platen. A squeegee having printing ink of a desired color applied is then manually moved across the silk screen with a suitable pressure to cause the ink to pass through the design area onto the textile material to imprint the design at the particular location. The same screen frame and screen with the same design and registration guide is then manually positioned against the main registration guide at each successive work station, with the squeegee applying the same color ink to each garment at each location so that all garments have the same design and color at the same position. The heater 56 is then turned on for a preset interval and the longitudinal heating elements are moved along the transverse tracks 62 across the first row of work stations on one side of the platform 18 and then back across the opposite side to apply sufficient heat to set the first color print on the surface of the garment at each station.

A second screen frame and screen with a related design offset at a predetermined distance from the first design pattern and having a corner registration guide that precisely registers the second pattern with respect to the first is then positioned over the same garments at each work station and aligned with the main registration guide. A second color ink may then be applied with a squeegee and that same color and offset pattern repeated at each work station on each garment so that all have the same patterns and colors at the same positions. Any number of colors and intricate related designs may thus be applied with precise registration at each work station on each like garment or article. The heater is turned on and heat applied across all of the garments in the two longitudinal rows after each new color ink application to set each portion of the design in one operation before applying the next color ink. Thus, a plurality of articles may have identical multi-color designs applied thereto in precise registration on each article in a rapid, efficient manner. The work stations may be varied in numbers and sizes and can be arranged in any desired combination in one or two rows to accommodate various articles of different types and sizes, with heaters of corresponding lengths being supplied.

While only a single embodiment has been illustrated and described, it is apparent that many variations may be made in the particular design and configuration without departing from the scope of the invention as set forth in the appended claims.

What is claimed is:

1. A silk screen printing machine comprising:

a plurality of like work stations positioned adjacent one another in a longitudinal row, each work station having a horizontal platform with supporting legs and an upright back;

a material holding platen and a platen support secured on each said platform;

a pivotable frame secured on each said back and having a pair of side bars extending forwardly over said platen and a cross member secured between said side bars, said pivotable frame having raised and lowered positions;

a rectangular platen frame secured to said cross member and side bars and having an open area adapted to engage said platen upon lowering said pivotable frame into a horizontal position;

movable support means for holding each said pivotable frame in said raised position and permitting said pivotable frame to be lowered onto said platen in a horizontal position;

a first registration guide secured at a corner area adjacent each said platen frame for receiving a silk screen frame having a second registration guide adapted to engage said first guide for aligning said silk screen frame over a predetermined area of each said platen; and movable longitudinal heater means mounted above said platens and extending over and movable across said row of work stations for applying heat to materials held on said platens after silk screen printing thereon.

2. The device of claim 1 wherein said heater means is mounted on rollers at opposite ends of said row of work stations to permit lateral movement back and forth across said platens.

3. The device of claim 2 wherein said plurality of work stations are positioned in two symmetrical longitudinal rows back to back with said heater means being movable back and forth across both rows.

4. The device of claim 1 wherein said platens and said open areas of said platen frames are rectangular.

5. The device of claim 1 including a plurality of silk screen frames having silk screens with predetermined patterns thereon and a second registration guide at a corner of each screen frame adapted to engage said first registration guide to align said patterns over said platens wherein the same pattern is printed successively on materials held in said plurality of platens upon application of printing ink through said silk screens.

6. The device of claim 5 wherein said first and second registration guides are in the form of 90° angle members.

7. The device of claim 6 wherein different silk screen frames having related patterns are mounted in silk screen frames so that the second registration guide provides an offset of the related pattern from the original pattern to permit application of multicolor patterns to materials.

8. The device of claim 3 including a pair of tracks at opposite ends of said row of work stations, said rollers and heater means being movable on said tracks.

9. The device of claim 5 wherein said heater means includes a timer for applying heat for a predetermined time to dry the ink on said materials after printing of a desired pattern with one silk screen frame successively at all of said work stations.

10. The device of claim 1 wherein said platen support extends forwardly of said platen to support said pivotable frame in a horizontal position.

11. The device of claim 10 wherein the lateral positions of said platens and platen supports are adjustable.

* * * * *